US011752599B2

(12) United States Patent
Bronson, Jr. et al.

(10) Patent No.: US 11,752,599 B2
(45) Date of Patent: Sep. 12, 2023

(54) HANDHELD FIXTURES

(71) Applicant: GLOBALFOUNDRIES U.S. Inc., Santa Clara, CA (US)

(72) Inventors: Dennis M. Bronson, Jr., Berlin, VT (US); Ronald L. Russotti, Essex Junction, VT (US); Daniel A. Bader, Winooski, VT (US)

(73) Assignee: GLOBALFOUNDRIES U.S. INC., Malta, NY (US)

( * ) Notice: Subject to any disclaimer, the term of this patent is extended or adjusted under 35 U.S.C. 154(b) by 196 days.

(21) Appl. No.: 17/192,224

(22) Filed: Mar. 4, 2021

(65) Prior Publication Data

US 2022/0281077 A1 Sep. 8, 2022

(51) Int. Cl.
*B25B 9/00* (2006.01)

(52) U.S. Cl.
CPC ..... *B25B 9/00* (2013.01)

(58) Field of Classification Search
CPC ..... B25B 9/00; B25B 13/00; B25B 13/06; B25B 13/24; B25B 13/18; B25B 13/44
See application file for complete search history.

(56) References Cited

U.S. PATENT DOCUMENTS

| | | | | |
|---|---|---|---|---|
| 5,440,784 | A | 8/1995 | Hull et al. | |
| 5,726,454 | A | 3/1998 | Chun | |
| 6,007,409 | A | 12/1999 | Chung | |
| 6,135,860 | A | 10/2000 | Tikhonov | |
| 6,261,031 | B1 | 7/2001 | Stipe et al. | |
| 8,740,513 | B2 | 6/2014 | Santamarina et al. | |
| 8,919,230 | B1 * | 12/2014 | Gao | B25B 23/0035 279/22 |
| 2003/0070246 | A1 | 4/2003 | Cavalheiro | |
| 2004/0117935 | A1 | 6/2004 | Cavalheiro | |
| 2008/0016991 | A1 * | 1/2008 | Gauthier | B25B 23/141 81/475 |
| 2009/0308209 | A1 * | 12/2009 | Cross | B25B 13/461 81/109 |
| 2013/0047796 | A1 * | 2/2013 | Chen | B25B 15/02 81/438 |
| 2022/0281077 | A1 * | 9/2022 | Bronson, Jr. | B25B 11/007 |

FOREIGN PATENT DOCUMENTS

| | | |
|---|---|---|
| CN | 205749078 | 11/2016 |
| KR | 200280367 | 7/2002 |
| KR | 20110034458 | 4/2011 |

OTHER PUBLICATIONS

"Processing Cross Sections for Sample Preparation", AZO Materials, Dec. 21, 2018, 2 pages.
"Lapping and Polishing Machines and Fixtures", Material Science and Metrology, www.emsdiasum.com, 2021, 12 pages.
"Polishing Solutions, Helping Your Lab To Shine!", www.ultratecusa.com, downloaded on Mar. 4, 2021, 1 page.

* cited by examiner

*Primary Examiner* — Lee D Wilson
(74) *Attorney, Agent, or Firm* — Anthony Canale; Andrew M. Calderon; Calderon Safran & Cole, P.C.

(57) ABSTRACT

The present disclosure relates to polishing tools and, more particularly, to hand polishing fixtures and methods of use. The structure includes: at least one hand grip which includes a shape accommodating a palm of an operator's hand; and a chuck having an interior space structured to fix a sample within the chuck and to extend below an underside surface of the at least one hand grip.

18 Claims, 5 Drawing Sheets

HANDHELD FIXTURES

FIELD OF THE INVENTION

The present disclosure relates to polishing tools and, more particularly, to handheld fixtures and methods of use.

BACKGROUND

Failure analysis (FA) is the process of determining how or why semiconductor devices fail. For example, failure analysis allows an engineer and/or designer to understand what caused a failure in order to prevent such failures in the future. By way of example, an electrical failure may be functional or parametric. Functional failure is the inability of a semiconductor device to perform its intended function; whereas, parametric failure is the inability of a semiconductor device to meet certain electrical specifications for a measurable characteristic.

Failure analysis can be performed in many different ways including using automated or manual processes. Manual processes remain the most controllable and accurate method for some failure analysis processes. The manual process requires a tool or fixture for holding a sample during grinding and polishing processes. These fixtures are limited in the sample sizes which can be mounted within the fixture; that is, current fixtures are not very adaptable in allowing different sized samples to be used with the same fixture. Also, some fixtures require hardened pieces of steel as foot pads in order to securely hold the sample. These foot pads, though, ride on polishing media, which causes contamination and scratching of the sample. This contamination can confuse the results of the failure analysis.

In addition, in a manual process, after the samples are encapsulated in epoxy, e.g., potted samples, and placed in the fixture, the operator (e.g., person with a hand) must hold the sample on grinding and polishing wheels. To hold the fixture requires the operator to use a pinch grip holding technique. A pinch grip refers to holding the sample using the index finger and middle finger on one side and the thumb on an opposing side while applying pressure on the polishing and/or grinding wheels. This causes operator fatigue and, in many instances, the pinch grip makes it difficult for the operator to maintain control of the sample for prolonged periods of time. It thus becomes difficult for the operator to make minor adjustments that are constantly needed to ensure that the desired plane of the sample is being maintained.

SUMMARY

In an aspect of the disclosure, a structure comprises: at least one hand grip comprising a shape which accommodates a palm of an operator's hand; and a chuck comprising an interior space structured to fix a sample within the chuck and to extend below an underside surface of the at least one hand grip.

In an aspect of the disclosure, a structure comprising: a body; a first handgrip connecting to a first side of the body; a second handgrip connecting to a second side of the body; and a chuck at an underside of the body and positioned to have at least a portion above a bottom surface of the first handgrip and the second handgrip.

In an aspect of the disclosure, a structure comprises: a first handgrip comprising a substantially spherical shape and a notched portion in a bottom side; a second handgrip comprising a substantially spherical shape and a notched portion in a bottom side; a connecting bar connecting to the first handgrip at a first side and the second handgrip at a second side; a recess on an underside of the connecting bar; and a chuck mounted with the recess of the connecting bar and aligned with the notch of the first handgrip and the notch of the second handgrip.

BRIEF DESCRIPTION OF THE DRAWINGS

The present disclosure is described in the detailed description which follows, in reference to the noted plurality of drawings by way of non-limiting examples of exemplary embodiments of the present disclosure.

DETAILED DESCRIPTION

The present disclosure relates to polishing tools and, more particularly, to handheld fixtures and methods of use. More specifically, the present disclosure relates to ergonomic handheld fixtures which provide for improved hand position during deprocessing of packaged samples, e.g., potted samples, during failure analysis testing. In embodiments, potted samples can be, for example, semiconductor chips, packaged integrated circuits, fibers in a photonics chip, etc., which are subjected to grinding and/or polishing processes for failure analysis. Advantageously, the ergonomic handheld fixtures allow the operator's entire hand(s) to hold the potted sample on a grinding and/or polishing wheel thus greatly reducing fatigue, amongst other advantages discussed below.

In general, the ergonomic handheld fixtures can be used for failure analysis and/or within metallurgical industries and/or rock and mineral industries. The ergonomic handheld fixtures greatly increase user time at the polishing and/or grinding wheels due to the reduction of fatigue which otherwise can occur with poor ergonomics. For example, the ergonomic handheld fixtures allow the operator (i.e., a person with a hand or a robotic mechanism with an arm/hand capable of holding the ergonomic handheld fixtures) to maintain a safe and ergonomic body position, e.g., particularly of the hands, by eliminating the use or need of a pinch grip holding technique. In addition, the ergonomic handheld fixtures eliminate foot pads riding on polishing media, hence avoiding contamination concerns caused by scratching issues. Moreover, the ergonomic handheld fixtures allow the user to maintain the proper plane of the sample, easily allow for adjustment of the sample plane, and may be adaptable for different sample sizes, even large sample sizes of, e.g., 75 mm by 75 mm in dimension.

Figure 1A:
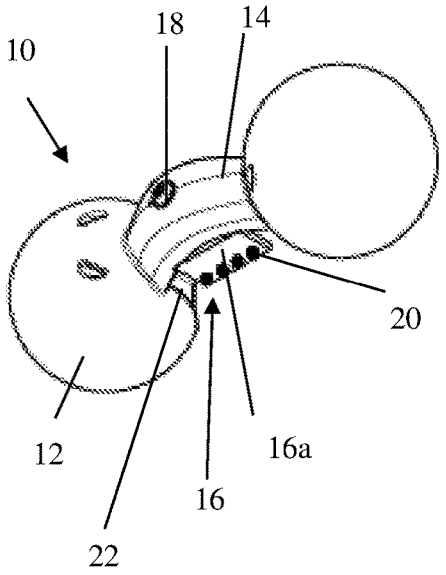
FIGS. 1A-1E show a handheld fixture in accordance with an aspect of the present disclosure.
Figure 1B:
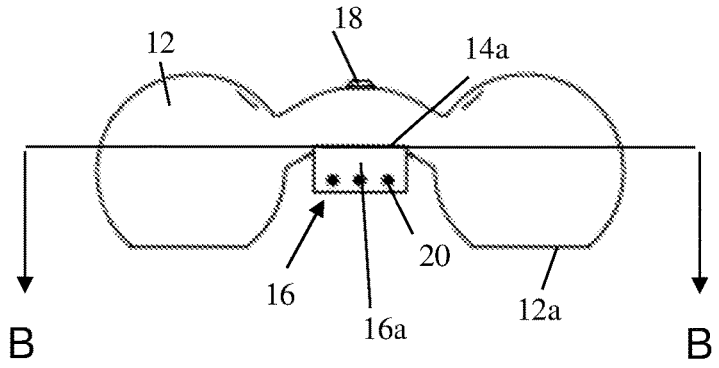
Figure 1C:
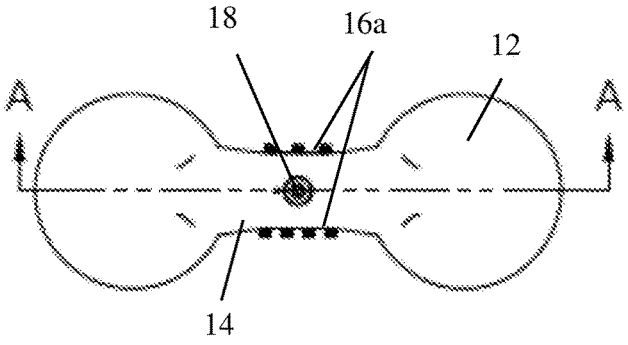
Figure 1D:
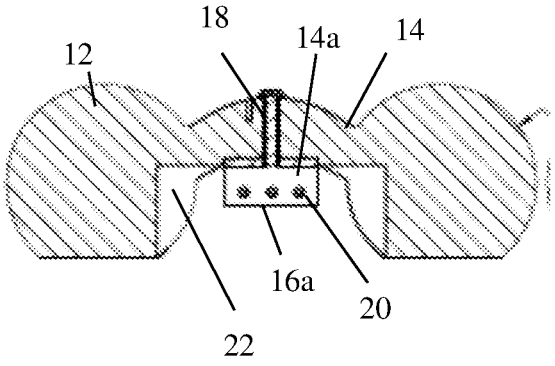

FIGS. 1A-1E show a handheld fixture in accordance with an aspect of the present disclosure. More specifically, FIG. 1A shows a perspective view of the handheld fixture 10, FIG. 1B shows a side view of the handheld fixture 10, and FIG. 1C shows a top view of the handheld fixture 10. In addition, FIG. 1D shows a cross-sectional view of the handheld fixture 10 along line A-A of FIG. 1C, whereas FIG.

1E shows a cross-sectional view of the handheld fixture 10 along line B-B of FIG. 1B. As in each of the different aspects described herein, the handheld fixtures may be fabricated using different materials such as aluminum or other metal alloys, plastic materials using injection molding, e.g., Acrylonitrile Butadiene Styrene (ABS) or other thermoplastic polymer used for injection molding applications, or other materials such as those used in 3-dimensional printing.

In embodiments, the handheld fixture 10 shown in FIGS. 1A-1E may polish flat potted samples, e.g., samples embedded within an epoxy, on its end for mechanical cross-sectioning. In addition, the handheld fixture 10 allows for the entire hand (e.g., two hands) to be used during the deprocessing operations, e.g., polishing and/or grinding, thereby eliminating the need for a pinch grip holding technique. Moreover, the handheld fixture 10 is structured to hold many different sample sizes and shapes, while allowing for minor adjustments to achieve a desired plane for the potted sample.

More specifically and referring to FIGS. 1A-1E, the handheld fixture 10 may be shaped as a barbell fixture comprising two handheld grips 12 connected to a central connecting body 14. In embodiments, the handheld grips 12 may be spherical shaped with an optional flat bottom surface 12*a*. The optional flat bottom surface 12*a* provides a tactile warning for the operator to not place their fingers on an underside of the handheld grips 12, as well as provides additional clearance or room for the potted sample to be ground during the deprocessing operations, e.g., grinding and/or polishing of the potted sample. For example, as the potted sample is ground and the handheld grips 12 become closer to the polishing and/or grinding wheel, the flat bottom surface 12*a* provides additional space to further polish and/or grind the potted sample on the polishing and/or grinding wheel. In further embodiments, other tactile warnings may be provided such as a ridge, recess or a series of indentations or protrusions about a meridian of the underside of the handheld grips 12, as represented by reference numeral 12*a*.

Still referring to FIGS. 1A-1E, the handheld grips 12 may be provided in many different sizes, e.g., to accommodate small, medium and large sized hands. In any scenario, the handheld grips 12 accommodate the entire hand of the operator, with a palm resting on an upper portion of the handheld grip 12 and each finger being able to wrap around portions of the handheld grip 12. In this configuration, the pinch grip holding technique is no longer required. Also, the central connecting body 14 may have a certain radius of curvature or be straight. For example, a smaller curvature may be used with a shorter sample size; whereas, a larger curvature may be used with a longer sample size. In one non-limiting example, the curvature may be in the range of about 50 mm to about 200 mm.

A specimen chuck 16 may be mounted to the handheld fixture 10. More specifically, the specimen chuck 16 may be mounted to an underside of the central connecting body 14 between the handheld grips 12. In embodiments, the specimen chuck 16 may be mounted within a recess 14*a* on an underside of the central connecting body 14. The recess 14*a* prevents rotation of the specimen chuck 16. The specimen chuck 16 may be mounted to the central connecting body 14 using any known mounting technique such as a screw 18 extending through the central connecting body 14; although other mounting methods are contemplated herein such as, e.g., epoxy, glue, rivet, etc. In further embodiments, the specimen chuck 16 may be integrated directly with the central connecting body 14, e.g., by injection molding or three dimensional printing. The specimen chuck 16 may be mounted above a lower surface of the handheld grips 12, e.g., above the flat bottomed surface 12*a*.

The specimen chuck 16 includes opposing walls or mounting surfaces 16*a* which effectively creates a space (e.g., hollow area) for mounting of a potted sample. In embodiments, the potted sample may be mounted between the opposing walls or mounting surfaces 16*a* with set screws 20, as an example. In this configuration, the recess 14*a* and the specimen chuck 16 is above the lower surface of the handheld grips 12 such that a top portion of a potted sample mounted within the specimen chuck will remain above the lower surface of the handheld grips 12. In embodiments, three set screws may be used on one mounting surface and four set screws may be used on the other mounting surface, in an offset manner; although other configurations are contemplated herein.

Figure 1E:
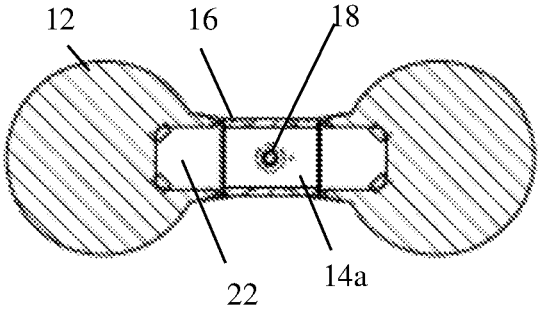

As shown most clearly in FIGS. 1D and 1E, in embodiments, the handheld fixture 10 also includes a recess (e.g., notched portion) 22 extending within the underside of the handheld grips 12. For example, the recess 22 extends into each of the handheld grips 12 and includes a flat surface which may accommodate a potted sample mounted within the specimen chuck 16. The recess 22 is aligned with the space between the mounting surfaces 16*a* of the specimen chuck 16, which effectively enlarges the holding area for the potted sample. Accordingly, the mounting surfaces 16*a* in combination with the expanded space underneath the handheld fixture 10, e.g., recess 22, allow for mounting of many different sized samples, e.g., upwards of 75 mm by 75 mm. In addition, the recess 22 may further prevent rotation of the potted sample.

Figure 2:
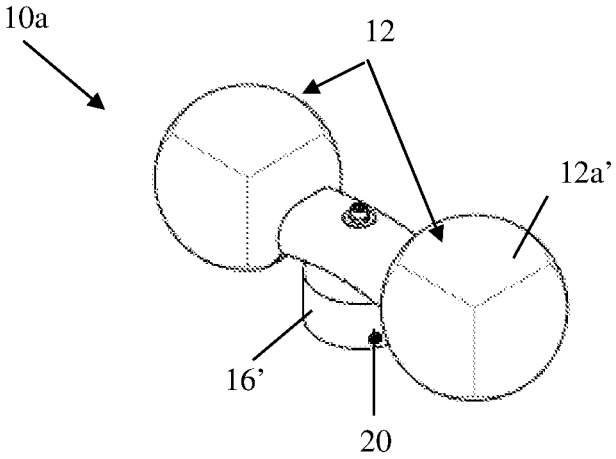
FIG. 2 shows a handheld fixture in accordance with another aspect of the present disclosure.

FIG. 2 shows a handheld fixture 10*a* with the handheld grips 12 comprising flat surfaces 12*a*' on all or some sides. In embodiments, the handheld grips 12 may include six (6) flat surfaces 12*a*' forming a hexagon; although other configurations are contemplated herein. For example, the flat surfaces 12*a*' may be provided on the sides and the bottom of the handheld grips 12, with the handheld grips 12 maintaining a top rounded shape. In addition, the specimen chuck 16' may be a round shape to accommodate a cylindrical potted sample; although other shapes are also contemplated herein, e.g., square, rectangle, etc. The specimen chuck 16' may be mounted to the central connecting body 14 by any known mounting technique such as a screw 18, etc., as already described herein. The specimen chuck 16' may also include one or more set screws 20 to securely fix the potted sample within the specimen chuck 16'. The remaining features of the handheld fixture 10*a* are similar to that already described with respect to the handheld fixture 10 of FIGS. 1A-1E.

In the deprocessing operation using the handheld fixtures 10, 10*a*, a structure or sample to be analyzed, e.g., package, chip, etc., may be embedded within epoxy to form a potted sample. The potted sample may then be mounted to the handheld fixture, within the specimen chuck 16, 16'. The sample may extend to within the recess 22. The set screws 20 may be rotated to securely fix the potted sample to the specimen chuck 16, 16'. The operator places his/her palm on the upper portion of the handheld grips 12 with their fingers around other portions of handheld grips 12. Once properly held, the operator may apply a downward force on the handheld grips 12 for the grinding and/or polishing processes. Due to the shape of the handheld grips 12, the pinch grip holding technique may be eliminated, hence improving control and contributing to less fatigue during the polishing and/or grinding processes. Also, the curvature of the central connecting body 14 may assist in the improved control during the deprocessing operation, as different curvatures may be used to change the center or rotation and inertial moment.

Figure 3A:
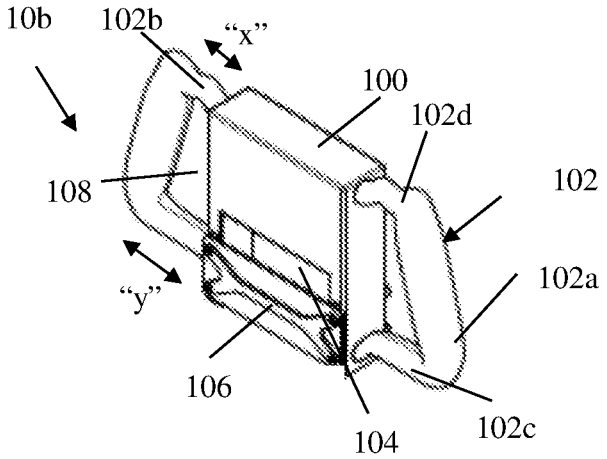
FIGS. 3A-3C show a handheld fixture in accordance with yet another aspect of the present disclosure.
Figure 3B:
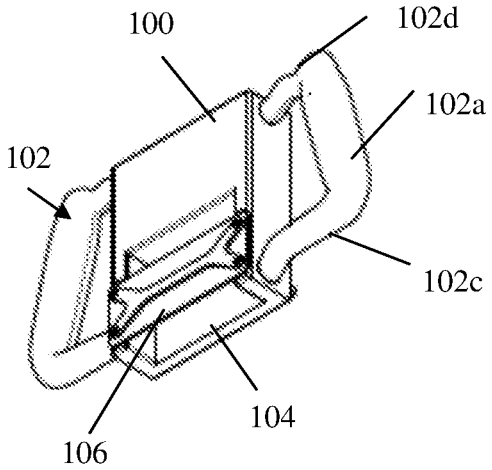
Figure 3C:
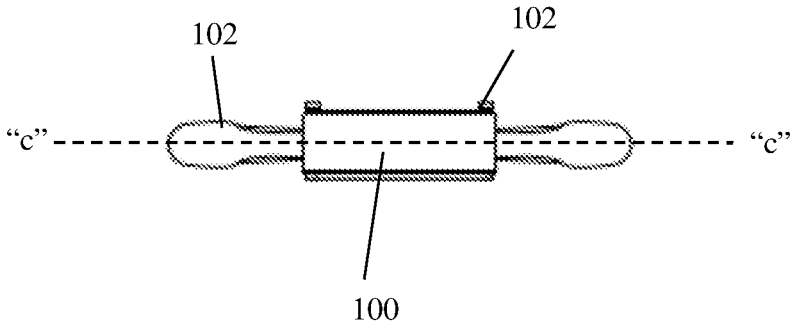

FIGS. 3A-3C show a handheld fixture in accordance with yet another aspect of the present disclosure. FIGS. 3A and 3B show different perspective views of the handheld fixture 10*b*; whereas, FIG. 3C shows a top view of the handheld fixture 10*b*. The fixture 10*b* may be used to polish flat potted samples for mechanical cross-sectioning. The handheld fixture 10*b* is also structured (e.g., designed) for the use of the entire hand during the deprocessing operation, hence eliminating the need for a pinch grip holding technique.

As shown in FIGS. 3A-3C, the handheld fixture 10*b* includes a body portion 100 and opposing handle grips 102. The body portion 100 may be generally rectangular in shape; although other shapes are contemplated herein. The body portion 100 includes a pocket or recess 104 at a bottom end thereof, which is structured to accommodate a potted sample. Although the pocket or recess 104 comprises a generally rectangular shape, other sizes and shapes are contemplated depending on the size and shape of the potted sample. A mounting bracket 106 extends across the pocket or recess 104 to securely fix the potted sample within the pocket or recess 104 of the handheld fixture 10*b*. As should be understood by those of skill in the art, the combination of the pocket or recess 104 and the mounting bracket 106 may be considered a specimen chuck.

Still referring to FIGS. 3A-3C, the opposing handle grips 102 are mounted on opposing sides of the body portion 100, forming a generally "D" shaped configuration. As an option, the opposing handle grips 102 may be mounted in a slightly offset manner from centerline "c"-"c" of the body portion 100, e.g., 3⁄16 inches, to correspond to a centerline of the potted sample mounted within the pocket or recess 104. This offset handle configuration enables or assists the operator in maintaining a desired plane for polishing.

In embodiments, each of the handle grips 102 includes a main handle portion 102*a*, an upper portion 102*b* and a lower portion 102*c*. The upper portion 102*b* includes indentations 102*d* structured to accommodate the operator's thumb when gripping the handle grips 102; whereas, the main handle portion 102*a* may be structured to accommodate a remaining portion of the hand, e.g., palm and fingers. Moreover, the lower portion 102*c* ensures that the operator's hands remain firmly on the handle grips 102, e.g., will not slip off, when applying a downward force during the deprocessing operations. A bottom of the pocket or recess 104 is below the lower portion 102*c*. In addition, the pocket or recess 104 extends within the body portion 100 to above the lower portion 102*c* of the handle grips 102.

In embodiments, the upper portion 102*b* has a length "x" and the lower portion 102*c* has a length "y", where "y">"x". The different lengths "x" and "y" result in an upper inward tilt angle of about 15° to 22° of the main handle portion 102*a*. That is, the body portion 100 and the main handle portion 102*a* are oriented in a non-parallel relationship to provide an ergonomic position for the operator's hands while applying a downward pressure during the grinding and/or polishing processes. The lengths "x" and "y" are also configured to allow the operator to easily fit their fingers through space 108 between the handle grips 102 and the body portion 100, while also ensuring that the fingers do not make contact with the body portion 100 during the deprocessing operations.

In the deprocessing operation using the handheld fixture 10*b*, the potted sample is placed within the pocket or recess 104 of the handheld fixture 10*b*. The mounting bracket 106 is mounted to the body portion 100 across the pocket or recess 104, securely fixing the potted sample within the pocket or recess 104. The operator places his/her fingers through space 108, resting their palm on the handle grips 102 with their fingers wrapping around the handle grips 102. The operator may then apply a downward force on the handle grips 102. The lower portion 102*c* of the handle grips 102 prevents the operator's hand from slipping off the handle grips 102 during the deprocessing operation. Also, by resting the hand on the lower portion 102*c* and/or placing the thumb within the indentations 102*d* on the upper portion 102*b*, it is possible to apply additional downward force on the potted sample during the deprocessing operations.

Figure 4A:
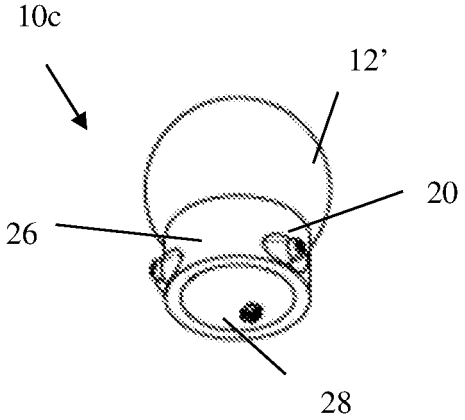
FIGS. 4A-4D show a handheld fixture in accordance with an additional aspect of the present disclosure.
Figure 4B:
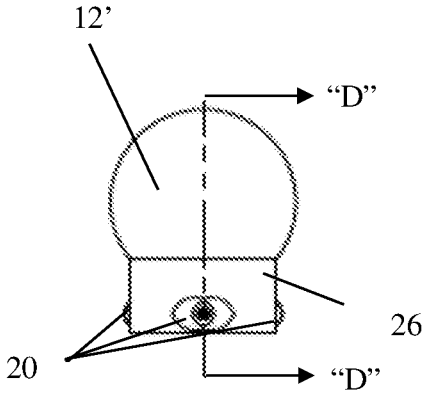
Figure 4C:
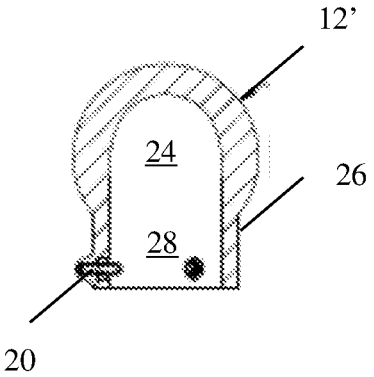
Figure 4D:
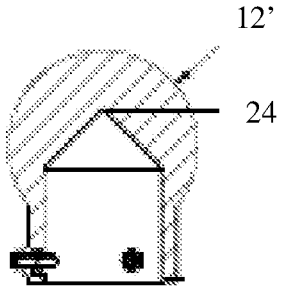
Figure 4E:
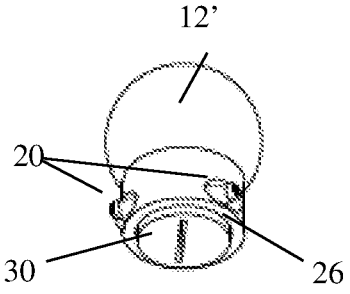
FIG. 4E shows a potted sample inserted into the handheld fixture shown in FIGS. 4A-4D.

FIGS. 4A-4D show a handheld fixture in accordance with an additional aspect of the present disclosure. More specifically, FIG. 4A shows a perspective view of the handheld fixture 10*c*, FIG. 4B shows a side view of the handheld fixture 10*c*, and FIGS. 4C and 4D show cross-sectional views of different aspects of the handheld fixture 10*c* along line D-D of FIG. 4B. FIG. 4E shows a potted sample inserted into the handheld fixture 10*c*. In embodiments, the handheld fixture 10*c* shown in FIGS. 4A-4E is designed and structured to polish round potted samples. In addition, the handheld fixture 10*c* allows for the entire hand (e.g., one hand) to be used during deprocessing operations, thereby eliminating the need for a pinch grip holding technique.

Referring to FIGS. 4A-4E, the handheld fixture 10*c* comprises a single spherical shaped handheld grip 12'. As shown in FIGS. 4C and 4D, the spherical shaped handheld grip 12' may include a hollow interior portion 24. In embodiments, the hollow interior portion 24 may include different three-dimensional shapes to accommodate different shapes of potted samples. For example, the hollow interior portion 24 of FIG. 4C may be a domed shape; whereas, the hollow interior portion 24 of FIG. 4D may be a conical shape. As with previous embodiments, the handheld grip 12' may be provided in many different sizes, e.g., to accommodate small, medium and large sized hands. In any scenario, the handheld grip 12' accommodates the entire hand of the operator, with a palm resting on an upper portion of the handheld grip 12' and each finger being able to wrap around other portions of the handheld grip 12'. Accordingly, in this configuration, the pinch grip holding technique is no longer required.

Still referring to FIGS. 4A-4E, a cylindrical shaped (e.g., collar) specimen chuck 26 extends from and may be integral with a bottom of the spherical shaped handheld grip 12'. The cylindrical shaped specimen chuck 26 also includes a hollow interior portion 28 that extends from and is aligned with the hollow interior portion 24 of the spherical shaped handheld grip 12'. The hollow interior portion 28 and the hollow interior portion 24 are sized and shaped to hold a potted sample 30, as shown in FIG. 4E. For example, a diameter of the hollow interior portion 28 may be about 50 mm; although other dimensions are also contemplated herein. The potted sample 30 may be fixed within the hollow interior portion 28 by set screws 20.

Figure 5A:
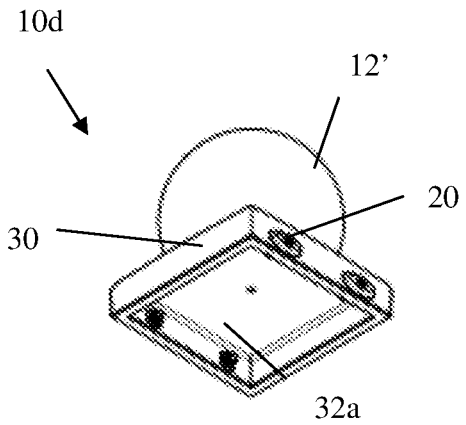
FIGS. 5A-5D show a handheld fixture in accordance with a further aspect of the present disclosure.
Figure 5B:
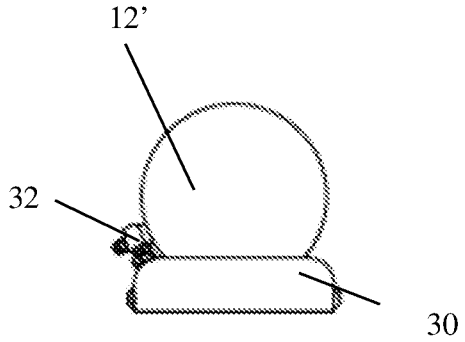
Figure 5C:
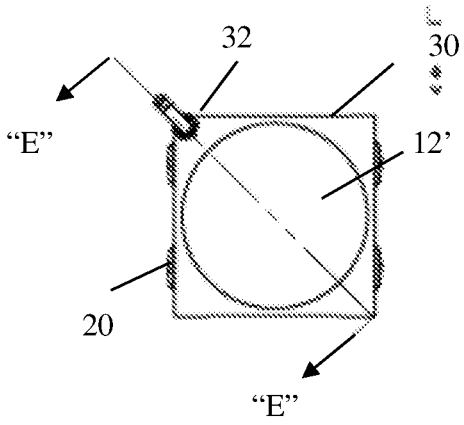
Figure 5D:
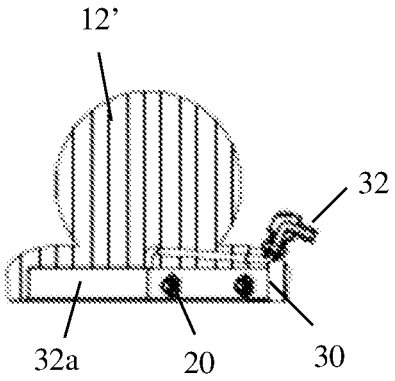

FIGS. 5A-5D show a handheld fixture in accordance with a further aspect of the present disclosure. More specifically, FIG. 5A shows a perspective view of the handheld fixture 10*d*, FIG. 5B shows a side view of the handheld fixture 10*d*, FIG. 5C shows a top view of the handheld fixture 10*d*, and FIG. 5 D shows a cross-sectional view of the handheld fixture 10*d* along line E-E of FIG. 5C. In embodiments, the handheld fixture 10*d* shown in FIGS. 5A-5D is designed and structured to polish flat potted samples. In addition, the handheld fixture 10*d* allows for the entire hand (e.g., one hand) to be used during the deprocessing operations, thereby eliminating the need for a pinch grip holding technique.

Referring to FIGS. 5A-5D, the handheld fixture 10*d* comprises a single spherical shaped handheld grip 12', similar to that shown in FIGS. 4A-4E. The spherical shaped handheld grip 12' may include a hollow interior portion or be solid. In any scenario, the handheld grip 12 is structured to accommodate the entire hand of the operator as already described herein, thus eliminating the need for a pinch grip holding technique. A square shaped specimen chuck 30 extends from and may be integral with a bottom of the spherical shaped handheld grip 12'. The specimen chuck 30 includes a hollow interior portion 32*a* that may be sized and shaped to hold a potted sample. It should be understood by those of skill in the art that the specimen chuck 30 may also be other shapes, e.g., polygonal shapes, circular, etc., to accommodate any shape potted sample. The potted sample may be fixed within the hollow interior portion 32 by set screws 20.

In this embodiment, a vacuum port 32 mounted to the specimen chuck 30 communicates with the hollow interior portion 32*a*. The vacuum port 32 may be connected to a vacuum source so as to remove material that is ground or polished from the potted sample during the deprocessing operations. The potted sample may be fixed within the hollow interior portion 28 by set screws 20.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed:

1. A structure comprising:

two hand grips each of which comprise a spherical shape which accommodates a palm of an operator's hand; and a chuck comprising an interior space which extends above a bottom surface of the two hand grips and which is structured to fix a sample within the chuck.

2. The structure of claim 1, wherein the two hand grips connect to opposing sides of a connecting bar spanning between the two hand grips, and a shape of each of the two hand grips comprises the spherical shape with at least one flat surface at a bottom portion.

3. The structure of claim 2, wherein the connecting bar comprises a curvature.

4. The structure of claim 2, further comprising a recessed portion on an underside of the connecting bar, wherein the chuck mounts within the recessed portion and above the underside surface of each of the two hand grips such that the interior space of the chuck extends to above the at least one flat surface of the two hand grips.

5. The structure of claim 4, wherein the two hand grips each include a recess on the underside surface, the recess aligns with mounting surfaces of the chuck.

6. The structure of claim 1, wherein the each of the two hand grips comprise a spherical handgrip, the chuck comprises a downward extending collar, and the downward extending collar and the single spherical handgrip each comprises hollow interior portions aligned with one another.

7. The structure of claim 1, further comprising a vacuum port on the chuck which communicates with the hollow interior portion of the chuck.

8. A structure comprising:

a body;

a first handgrip connecting to a first side of the body;

a second handgrip connecting to a second side of the body; and a chuck at an underside of the body and positioned to have at least an interior portion which engages a sample and which is positioned above a bottom surface of the first handgrip and the second handgrip.

9. The structure of claim 8, wherein the first handgrip and the second handgrip each comprise a spherical shape with a tactile impression or protrusion on an underside.

10. The structure of claim 9, wherein the tactile impression or protrusion comprises a flat surface and the body comprises a connecting bar with a recess on an underside, and the chuck is mounted within the recess.

11. The structure of claim 10, wherein the first handgrip and the second handgrip each include a recessed portion on an underside surface, aligned with the chuck.

12. The structure of claim 8, wherein the chuck comprises a combination of a recess within the body and a mounted bracket extending over the recess and secured to the body.

13. The structure of claim 12, wherein the first handgrip and the second handgrip comprise a "D" shape, the first handgrip and the second handgrip each comprises an upper portion, a lower portion and a main handle portion between the upper portion and the lower portion, the upper portion comprising a length "x" and the lower portion comprising a length "y", where "y">"x".

14. The structure of claim 13, wherein the first handgrip and the second handgrip are mounted off center with respect to the body.

15. A structure comprising:

a first handgrip comprising a substantially spherical shape and a notched portion in a bottom side;

a second handgrip comprising a substantially spherical shape and a notched portion in a bottom side;

a connecting bar connecting between and to the first handgrip at a first side and the second handgrip at a second side;

a recess on an underside of the connecting bar; and a chuck mounted within the recess of the connecting bar and aligned with the notched portion of the first handgrip and the notched portion of the second handgrip.

16. The structure of claim 1, wherein the chuck connects to a connecting bar between the two hand grips and is completely above a bottom surface of the two hand grips.

17. The structure of claim 16, wherein the chuck includes a plurality of set screws on sidewalls of the chuck.

18. The structure of claim 16, wherein the chuck is connected to the connecting bar by a screw extending to an upper surface of the connecting bar between the two hand grips.

* * * * *